US005493387A

United States Patent [19]

VonHoene et al.

[11] Patent Number: 5,493,387

[45] Date of Patent: Feb. 20, 1996

[54] THICK OVERCOATED PR AND COLOR ON COLOR

[75] Inventors: Donald C. VonHoene, Fairport; Richard L. Post, Penfield, both of N.Y.

[73] Assignee: Xerox Corporation, Stamford, Conn.

[21] Appl. No.: 352,951

[22] Filed: Dec. 9, 1994

[51] Int. Cl.[6] ..... G03G 15/01

[52] U.S. Cl. ..... 355/328

[58] Field of Search ..... 355/202, 326 R, 355/327, 328

[56] References Cited

U.S. PATENT DOCUMENTS

| | | | |
|---|---|---|---|
| 3,832,170 | 8/1974 | Nagamatsu et al. | 96/1.2 |
| 4,068,938 | 1/1978 | Robertson | 355/4 |
| 4,078,929 | 3/1978 | Gundlach | 96/1.2 |
| 4,189,224 | 2/1980 | Sakai | 355/4 |
| 4,264,185 | 4/1981 | Ohta | 355/4 |
| 4,335,194 | 6/1982 | Sakai | 430/42 |
| 4,467,023 | 8/1984 | Chu et al. | 430/66 |
| 4,479,242 | 10/1984 | Kurata | 382/17 |
| 4,509,850 | 4/1985 | Weigl | 355/4 |
| 4,562,129 | 12/1985 | Tanaka et al. | 430/42 |
| 4,901,100 | 2/1990 | DiBianca | 355/328 |
| 4,922,298 | 5/1990 | Folkins et al. | 355/328 X |
| 4,937,636 | 6/1990 | Rees et al. | 355/328 |
| 5,010,367 | 4/1991 | Hays | 355/247 |
| 5,089,847 | 2/1992 | Folkins | 355/202 |
| 5,172,170 | 12/1992 | Hays et al. | 355/259 |

*Primary Examiner*—Fred L. Braun

[57] ABSTRACT

Highlight color images are created in a single pass using a light lens copier. Image exposure is accomplished using light/lens scanning of a multi-color original together with simultaneous shunting. Using a special photoreceptor configuration and a sequence of image creation steps including the aforementioned simultaneously shunting and exposure step, balanced latent images are formed across the photoreceptor structure. By balanced is meant that latent images exist across both an overcoat layer of the photoreceptor and the rest of the photoreceptor. Such an arrangement precludes development of the image across the overcoat layer if the photoreceptor were to be moved past a development system. Thus, an electrostatic voltmeter used to read the surface potential in the image areas would read zero or near zero volts. Following formation of a plurality of balanced images, each of the balanced images is, one at a time, caused to become unbalanced prior to its movement past an appropriate development system. Such unbalancing is effected using a low resolution ROS or other suitable exposure device. Each low resolution ROS would provide full exposure sufficient to discharge the photoreceptor leaving the portion of the latent image potential of interest across only the overcoating thereby enabling its development.

17 Claims, 1 Drawing Sheet

THICK OVERCOATED PR AND COLOR ON COLOR

BACKGROUND OF THE INVENTION

This invention relates generally to the creation of highlight color images in a single pass and more particularly to the use of light lens imaging techniques for such purposes.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation. The areas of charge dissipated on the photoreceptor correspond to residual or background voltage levels. Thus, the photoreceptor contains two voltage levels in the case of a binary digital system. In the case of a light/lens system a whole array of voltage levels are present on the photoreceptor.

This latent charge pattern is rendered visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Many documents and printed materials consist of black, white (color of substrate) and one highlight color. It is a very important and formidable task to print and copy these documents. A commercially available printer (Xerox 4850)is capable of making such prints in a single pass. That printer utilizes a technique known as tri-level imaging. Tri-level imaging splits the Photo Induced Discharge Curve (PIDC) resulting in low development potentials. Heretofore, Raster Output Scanners have been used for creating tri-level images.

In a business office environment it is frequently desirable to reproduce at high speeds original documents containing highlighted portions. Typically the original document will have information in one or more colors and black. It is well known in the art to produce two color output copies using a multi-pass system, a present commercial example being the Canon 3625 copier. For this type of system, an operator utilizes a mimic-type electronic edit pad to delineate areas of an original it is desired to highlight. The coordinates of a selected area are entered into machine memory. During a first exposure cycle all areas on the photoreceptor are erased save the selected highlight color area which is then subsequently developed with the appropriate color toner. The resulting image is transferred to a copy sheet, fused and returned to the developer station entrance zone where it is re-registered. A second exposure of the original is made and the highlight area only is erased. The resulting latent image is developed with conventional black toner, and transferred to the copy sheet which is then fused and the copy sheet conveyed to an output tray.

The type of system exemplified by the Canon 3625 has several disadvantages; it requires an expensive electronic component, the edit pad as well as additional memory. Registration following the first exposure is difficult to achieve. Since the system is two cycle (two pass) the productivity is limited. It is therefore highly desirable for an electrophotographic reproduction machine to reproduce both the black and the color (red for most highlighting purposes)information in a single pass. By single pass, it is meant that a composite electrostatic latent image having regions corresponding to the red information and black information is recorded on the photoconductive surface or any combination of two desired colors. This composite electrostatic latent image is developed with black and red toner particles to produce a two-color toner powder image. This two-color powder image is subsequently transferred to the copy sheet and permanently affixed thereto. In this way, a highlighted color copy of the original document may be readily produced at relatively high speeds, automatically and in perfect registration.

Following is a discussion of additional prior art, incorporated herein by reference, which may bear on the patentability of the present invention. In addition to possibly having some relevance to the patentability thereof, these references, together with the detailed description to follow, may provide a better understanding and appreciation of the present invention.

U.S. Pat. No. 4,937,636 granted to Rees et al describes one technique that involves tri-level imaging in a light lens copier for creating highlight color images in a single pass. In that patent, an original to be copied is modified using fluorescent ink on selected portions thereof. Light reflected from the modified original is transmitted through a colored filter and is projected onto the surface of a monopolar photoreceptor. Light incident on the fluorescent ink is absorbed over a specific wavelength range and is re-admitted at a higher wavelength. This light, and light reflected from the white background, are transmitted through a filter of a color associated with the re-emited wavelength. Light reaching the photoreceptor discharges charged areas thereon at two energy levels. The resulting latent image incorporates three separate discharge levels corresponding to the black image information, color fluorescent areas, and background areas. The black and color areas are developed with appropriate colored toner by developer units biased at the appropriate levels. The requirement modifying an original using special inks presents a serious drawback to commercial acceptance of the process.

U.S. Pat. No. 3,832,170 Nagamatsu et al., describes a photosensitive member having an insulating layer acting as a color filter. The photoconductive drum is divided into three segments, each segment corresponding to a different colored electrostatic latent image. These differently colored electrostatic latent images are then developed by toner particles complementary in color thereto. The toner powder images are then transferred to a copy sheet in superimposed registration to form a multicolor copy corresponding to the original document.

U.S. Pat. No. 4,078,929 Gundlach, discloses a reproduction machine which can form a two color copy of an original document either using conventional light lens exposure techniques, or electronically. A charge pattern of a single polarity and having at least three different levels of potential is formed on a photoreceptor and developed in two colors by utilizing relatively negatively charged toner particles of one color and relatively positively charged toner particles of a second color. The exposure system requires the use of black and white images on an original document having a intermediate (grey) color.

U.S. Pat. No. 4,189,224 Sakai, discloses a photoconductive drum formed with first and second photoconductive layers of different spectral sensitivities. The photoconductive drum is charged and exposed causing electrostatic latent images to be formed on the respective layers according to the color within the original document. The charges of the latent images are of opposite polarity. Toner particles, similarly of opposite polarity, are used to develop the respective latent images. The toner particles of different colors. In this way, a two-color copy is formed.

U.S. Pat. No. 4,264,185 Ohta, describes an electrophotographic printing machine employing a photoconductive drum formed with at least two photoconductive layers of different spectral sensitivities. One layer may be panchromatic with the other layer being insensitive to red light. The drum is charged, at least twice, with opposite polarities to produce the charge pattern. A light image of the original document then exposes the charged regions of the drum. This results in positive and negative electrostatic latent images being recorded thereon. The latent images are developed with black and red toner particles of opposite polarity to form a two-color copy.

U.S. Pat. No. 4,335,194, Sakai, discloses a photoconductive member comprising a red sensitive photoconductive layer and a red-insensitive photoconductive layer. Two colors are printed by charging and exposing to white light, irradiating with red light and charging to an opposite polarity, charging to the same polarity as an opposite polarity, charging to the same polarity as the first polarity, and developing with red and black toners of opposite polarity.

U.S. Pat. No. 4,509,850, Weigl, teaches an electrophotographic printing machine capable of reproducing both black information and red information in a single pass. A continuously charged area and a modulated charged area are recorded onto a photoconductive surface. The modulated charged area is developed with polar or polarizable marking particles of a first color while the continuously charged area is developed with charged marking particles of a second color.

U.S. Pat. No. 4,479,242, Kurata, discloses a dichromatic reading device capable of separating a specific color from other colors of and original document. An electric circuit is provided which obtains the difference between the level of an image signal readout without a filter, and the level of a signal readout through a complementary filter for the specific color. Subsequently, an image signal for the specific color is produced from the difference.

U.S. Pat. No. 4,068,938, Robertson, teaches an electrophotographic printing machine capable of reproducing two color copies from a two color original document. An electrostatic latent image having three discrete potential levels is recorded onto a photoconductive drum. A high level is developed by particles of a first color corresponding to a dark color of the original document and a low level is developed by particles of a second color. The underdeveloped portion remains the color of the sheet of support material.

U.S. Pat. No. 4,562,129, Tanaka, discloses a bipolar photoreceptor which permits three different potential levels to be formed thereon.

U.S. patent application Ser. No. 08/301,922 discloses a two-pass, light/lens, highlight color copier in which large contrast images are created providing relatively large development fields or potentials compared to those associated with tri-level imaging.

U.S. patent application Ser. No. 08/237,945, now U.S. Pat. No. 5,452,074, filed on May 2, 1994 discloses a method and apparatus for forming orthographic color images. A relatively high resolution ROS is utilized to simultaneously form a plurality full contrast images thereby yielding the registration precision available in tri-level imaging while providing full contrast images of conventional xerography as discussed above.

The imaging system disclosed has a conventional light lens imaging or exposure station, one Charged Area (CAD) development subsystem including positively charged black toner, and one CAD scavengeless development subsystem including a positively charged highlight color toner. Other subsystems normally found in the xerographic imaging environment, such as charging, exposure, transfer and fusing are also employed. A high contrast CAD image is formed in the first pass using conventional Light/Lens scanning optics. A spectral filter is used with the Light/Lens optics during a second pass for forming a highlight color image.

From the discussion above it can be seen that those systems which utilize a single pass highlight color creation (e.g. Gundlach) require the formation of separate and distinct levels of photoconductor charge. One level (high) corresponds to black information, an intermediate level corresponds to white background and a third level (low) corresponds to the highlight color (red). Alternatively, in the case of the '483 patent, both images can be offset from the background voltage in the same direction. Other prior art references cited above disclose some kind of bi-polar photoreceptor comprising multiple layers, each layer sensitive to a different color.

It would be desirable to enable a single pass color highlight system which does not require a bi-polar photoreceptor. It would also be desirable for the system to utilize a conventional light lens scanning system to make highlight color copies in a single pass of originals having normal color and black images on a white background unlike, for example, Gundlach which makes two color copies either from a CRT display or from an original with a grey background.

BRIEF SUMMARY OF THE INVENTION

According to the present invention, there is provided single pass light/lens highlight color copier which uses strong development potentials and charged area development.

The imaging system disclosed herein has a light lens imaging or exposure station, one Charged Area (CAD) Development subsystem including positively charged black toner, and one CAD scavengeless development subsystem including a positively charged highlight color toner. Other subsystems normally found in the xerographic imaging environment, such as charging, exposure, transfer and fusing are also employed. Since both development subsystems are CAD, and the toner is of the same sign, the pretransfer step required by tri-level xerography is not needed.

Image exposure is accomplished using light/lens scanning of a multi-color original together with simultaneous shunting. Using a special photoreceptor configuration and a sequence of image creation steps including the aforementioned simultaneously shunting and exposure step, balanced latent images are formed across the photoreceptor structure. By balanced is meant that latent images exist across both an overcoat layer of the photoreceptor and the rest of the photoreceptor. Such an arrangement precludes development of the image across the overcoat layer if the photoreceptor were to be moved past a development system. Thus, an electrostatic voltmeter used to read the surface potential of the balanced image areas would read zero or near zero volts.

Following formation of the a plurality of balanced images, each of the balanced images is, one at a time, caused to become unbalanced prior to their movement past an appropriate development system. Such unbalancing is effected using a low resolution ROS or other suitable exposure device. Each low resolution ROS or other suitable exposure device would provide full exposure sufficient to discharge the photoreceptor leaving the potion of the latent image potential of interest across only the overcoating thereby enabling its development.

An edit pad is used to digitize original document information for creating bit streams representative of original (i.e. black and color image information) images. The bit streams are utilized by an Electronic SubSystem (ESS) for controlling the timing of energization of low capacity flood illumination devices, for example, low resolution Raster Output Scanners (ROS). The data acquisition, data storage, and computation involved in this invention are well within the capabilities of present microprocessor-based machine controllers.

DETAILED DESCRIPTION OF THE PREFERRED EMBODIMENT OF THE INVENTION

Figure 1A:
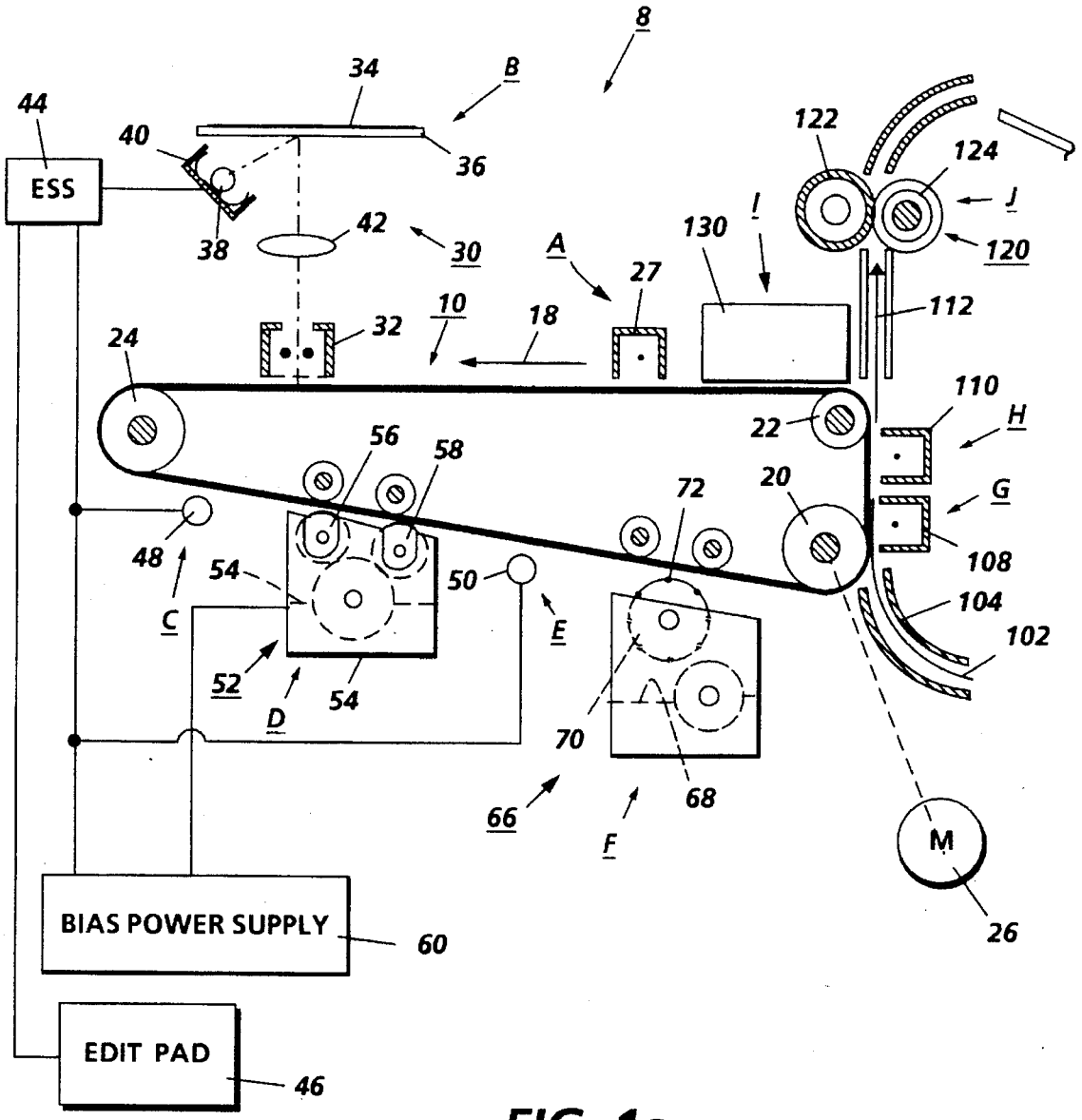
FIG. 1*a* depicts a schematic representation of a light lens creation device incorporating the invention.
Figure 1B:
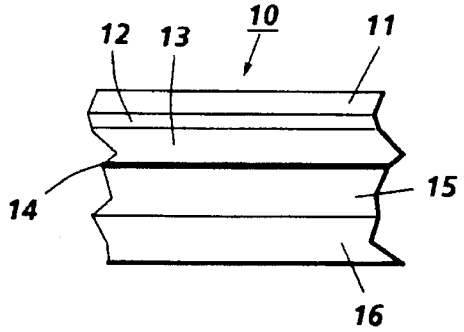
FIG. 1*b* depicts an enlarged end view of a photoreceptor belt.

As shown in the Figure, a highlight color printing apparatus in which the invention may be utilized comprises a xerographic processor module 8 including a charge retentive member in the form of a photoreceptor belt 10 which is mounted for movement in an endless path past a charging station A, a Light Lens (L/L) exposure station B, a first low resolution exposure station C, a first development station D, a second low resolution exposure station E, a second developer station F, a transfer station G, a Detack station H, a cleaning station land a fusing station J. The belt 10 comprises a relatively thick (i.e. ~10 microns) overcoating layer 11 fabricated from a polycarbonate resin such as Makrolon™. An adhesive backed or thermally bonded layer can be used. The overcoating layer 11 serves to protect a binder generator layer (BGL) 12 fabricated by dispersing photoconductive particles such as trigonal selenium (tSe) into a film forming binder or polymer such as polyvinyl carbazole (PVK). The BGL has a thickness of ~2 microns. A transport layer 13 with suitable interfaces and fabricated from polyphenyl diame active small molecules which are molecularly dispersed into a polycarbonate resin binder such as Makrolon™ forms the other layer of the photoreceptor belt 10. Because of the protection provided by the thick overcoating layer 11, the generating layer 12 can be placed above the transport layer 13. The layers 11, 12 and 13 are supported by a suitable polyester carrier layer 15 which is adhered to an anticurl back coating 16 fabricated from a polycarbonate resin. A ground plane 14 is provided intermediate the transport layer 13 and the carrier layer 15.

Belt 10 moves in the direction of arrow 18 to advance successive portions thereof sequentially through the various processing stations disposed about the path of movement thereof. Belt 10 is entrained about a plurality of rollers 20, 22 and 24, the former of which can be used as a drive roller and the latter of which can be used to provide suitable tensioning of the photoreceptor belt 10. Motor 26 rotates roller 20 to advance belt 10 in the direction of arrow 18. Roller 20 is coupled to motor 26 by suitable means such as a belt drive, not shown.

As can be seen by further reference to the Figure, initially successive portions of belt 10 pass through charging station A. At charging station A, a corona discharge structure comprising a DC scorotron 27 charges the belt 10 to a selectively high uniform negative potential. Providing a hole (+)injecting contact in the transport layer 16 results in a reservoir of charge for collapsing the field across the photoreceptor. As a result, no flooding is needed as in the case of the second step of the Canon NP process. Because of the hole injection, the initial charging step leaves an image voltage pattern across the overcoating. Material for hole injecting contact as disclosed in U.S. Pat. No. 4,467,023 is contemplated.

Next, the charged portions of the photoreceptor surface are advanced through exposure station B where simultaneous imagewise exposure using a light/lens (L/L) scanning system generally indicated at 30 and AC shunting of the photoreceptor surface potential to zero volts with an AC scorotron 32 is effected. The L/L scanning system is used to scan an original document 34 on a platen 36. To this end, the L/L system is provided with an exposure lamp 38 supported by a reciprocating carriage 40, illumination from the lamp being projected onto the photoreceptor 10 through a lens 42. Alternatively, original document movement across the platen is contemplated.

Operation of the scanning system 30 and scorotron 32 as well as other components of the module 8 is under the control of an Electronic Subsystem 44 (ESS). An edit pad 46 is used to digitize original document information for creating bit streams representative of original (i.e. black and color image information) images. The bit streams are utilized by the ESS for controlling the timing of energization of low flood illumination devices, for example, low resolution Raster Output Scanners (ROS) 48 and 50. The data acquisition, data storage, and computation involved in this invention are well within the capabilities of present microprocessor-based machine controllers.

As the result of the simultaneous imagewise exposure and AC shunting the photoreceptor can be divided into images that can be developed with two or more different colored toners. The images are electrostatically balanced, meaning that if they were to be moved past a toner development system no development would occur. However, upon flood exposure of one of the images, with one of the low resolution devices 48, 50 one of the images would become unbalanced and therefore developable.

After the simultaneous exposure and shunting step, the photoreceptor is moved past the ROS 48 which flood illuminates regions of the document to be developed using developer housing structure 52. By way of example, these regions may correspond to black images of the original. Unlike a high resolution ROS of the type used in prior art devices, the ROS 48 operates to fully discharge the photoreceptor within a defined area thereof which corresponds to a black image to be created. Thus, rather than operating in a pulsed (i.e. "On"-"Off") mode it is operated in the continuously "On" mode except for being turned off at the boundaries delimiting the defined area. To this end the ROS 48 must be operative to turn off and on within ±0.01 to 0.1 inches of the aforementioned boundaries.

While one of the images formed is unbalanced after flood exposure and therefore capable of being developed using the developer housing structure 52, the other image or images remain balanced and undevelopable. Thus, when a balanced image passes the developer housing structure 52 it does not become developed.

By way of example the developer housing structure 52 may contain a magnetic brush developer structure containing a developer mixture 54 of carrier particles and toner particles. The toner particles may comprise black pigment. Thus, when the portion of the photoreceptor containing the unbalanced image, due to flood illumination with source 48, moves past the developer structure 52, black toner particles are deposited thereon, such deposition being effected with magnetic brush rollers 56 and 58. These toner particles are oppositely charged to the charge of the unbalanced image on the photoreceptor. Thus, they are positively charged. The developer housing structure 52 is electrically biased to a negative bias voltage of approximately −200 volts with a DC bias source 60.

Following the development of the unbalanced image with black toner, the photoreceptor is moved past the low resolution ROS 50 which flood illuminates regions of the photoreceptor corresponding to the color image on the original thereby forming an unbalanced color image to be developed using a non-interactive developer structure 66. The developer structure is preferably a non-interactive development system of the type disclosed in U.S. Pat. No. 5,010,367 granted to Dan A. Hays on Apr. 23, 1991. It is adapted to deposit color toner from a developer mixture 68 on the unbalanced color image. The specific color is not critical. It may comprise one of the additive colors red, green and blue. Its charge polarity is the same as toner.

Preferably, the non-interactive developer structure is of the type disclosed in U.S. Pat. No. 5,172,170 granted to Hays et al on Dec. 15, 1992. It comprises an embedded donor roll structure 70. An AC/DC electrical biasing arrangement, not shown, is provided for applying suitable voltage biases for liberating toner particle from the donor roll surface for forming a cloud of toner in a development zone 72 intermediate the photoreceptor and the donor roll structure. The biasing arrangement also controls the spacing of the toner cloud relative to the photoreceptor. Because the polarity of the developed black image is at a low negative voltage, approximately equal to the developer bias for the developer structure 52, the positive color toner particles do not deposit on that image. The bias of the non-interactive system could be set higher (i.e. more negative) than that of the initial black station to ensure no color development on top of the black image. There would be sufficient color development potential remaining after the increased color bias is used.

Subsequent to image development a sheet of support material 102 is moved through a chute 104 into contact with the toner image at transfer station G. The sheet of support material is advanced to transfer station G by conventional sheet feeding apparatus comprising a part of the paper handling module, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 108 which sprays positive ions onto the backside of sheet 102. This attracts the negatively charged toner powder images from the belt 10 to sheet 102. A detack dicorotron 110 is also provided for facilitating stripping of the sheets from the belt 10.

After transfer, the sheet continues to move, in the direction of arrow 112, onto a conveyor (not shown) which advances the sheet to fusing station K. Fusing station K includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to catch trays (not shown) for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I. A cleaning housing 130 supports therewithin a cleaning brush (not shown) supported in cleaning relationship with photoreceptor belt 10. The brush is generally cylindrical in shape, with a long axis arranged generally parallel to photoreceptor belt 10, and transverse to photoreceptor movement direction 18. The brush, has a large number of insulative fibers mounted on a base journaled for rotation (driving elements not shown). The brush is typically detoned using a pair of detoning rolls, not shown. The toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/photoreceptor interference is usually about 2 mm. Pre and post cleaning corona and/or illumination (not shown) are contemplated where needed.

What is claimed is:

1. A method of creating highlight color images on a retentive surface in a single pass including the steps of:

moving said charge retentive surface past a plurality of process stations including a charging station where said charge retentive surface is uniformly charged;

scanning a multi-color original document to selectively discharge said charge retentive surface for forming a plurality of balanced electrostatic images therein, providing illumination means for rendering one of said balanced images unbalanced;

providing means for restricting the operation of said illuminating means such that it illuminates only said one of said balanced images for forming an unbalanced image;

developing said unbalanced image using electrostatically attractable toner particles;

illuminating another one of said balanced images for forming another unbalanced image;

providing means for ensuring that said step of illuminating another one of said balanced images impinges substantially only on said another one of said balanced images; and developing said another unbalanced image.

2. The method according to claim 1 wherein said balanced images are at different charge levels after being rendered unbalanced.

3. The method according to claim 2 wherein said illumination means comprises first and second low resolution illumination sources.

4. The method according to claim 3 wherein said first and second low resolution sources comprise low resolution ROS devices.

5. The method according to claim 4 wherein said steps of restricting and ensuring comprise an edit pad to provide information for controlling the operation of said illumination sources.

6. The method according to claim 1 wherein said steps of restricting and ensuring comprise an edit pad to provide information for controlling the operation of said illumination means.

7. The method according to claim 6 wherein unbalanced images comprise areas at different charge levels.

8. The method according to claim 7 wherein said illumination means comprises first and second low resolution illumination sources.

9. The method according to claim 8 wherein said first and second low resolution sources comprise low resolution ROS devices.

10. Apparatus for creating highlight color images on a charge retentive surface in a single pass comprising:

means for moving said charge retentive surface past a plurality of process stations including a charging station where said charge retentive surface is uniformly charged;

means for scanning a multi-color original document to selectively discharge said charge retentive surface for forming a plurality of balanced electrostatic images therein, illumination means for rendering one of said balanced images unbalanced;

means for restricting the operation of said illuminating means such that it illuminates only said one of said balanced images for forming an unbalanced image;

means for developing said unbalanced image using electrostatically attractable toner particles;

means for illuminating another one of said balanced images for forming another unbalanced image;

means for ensuring that the means for illuminating another one of said balanced images impinges substantially only on said another one of said balanced images; and means for developing said another unbalanced image.

11. Apparatus according to claim 10 wherein said balanced images are at different charge levels after being rendered unbalanced.

12. Apparatus according to claim 11 wherein said illumination means comprises first and second low resolution illumination sources.

13. Apparatus according to claim 12 wherein said first and second low resolution sources comprise low resolution ROS devices.

14. Apparatus according to claim 13 wherein said means for restricting and ensuring comprises an edit pad to provide information for controlling the operation of said illumination sources.

15. Apparatus according to claim 14 said electrostatic images comprising areas at different charge levels including said unbalanced images.

16. Apparatus according to claim 15 wherein said illumination means comprises first and second low resolution illumination sources.

17. Apparatus according to claim 16 wherein said first and second low resolution sources comprise low resolution ROS devices.

* * * * *